US005318605A

United States Patent [19]

Carman

[11] Patent Number: 5,318,605

[45] Date of Patent: Jun. 7, 1994

[54] GLASS-CERAMIC BONDED ABRASIVE ARTICLES

[75] Inventor: Lee A. Carman, Worcester, Mass.

[73] Assignee: Norton Company, Worcester, Mass.

[21] Appl. No.: 892,493

[22] Filed: Jun. 3, 1992

Related U.S. Application Data

[63] Continuation of Ser. No. 704,165, May 22, 1991, abandoned, which is a continuation-in-part of Ser. No. 638,262, Jan. 7, 1991, abandoned.

[51] Int. Cl.[5] ..... B24D 3/18

[52] U.S. Cl. ..... 51/308; 51/307; 51/309; 501/7; 501/32

[58] Field of Search ..... 51/307, 308, 309; 501/8, 32, 153, 7, 12

[56] References Cited

U.S. PATENT DOCUMENTS

| | | | |
|---|---|---|---|
| 4,314,827 | 2/1982 | Leitheiser et al. | 51/298 |
| 4,543,107 | 9/1985 | Rue | 51/309 |
| 4,744,802 | 5/1988 | Schwabel | 501/153 X |
| 4,749,665 | 6/1988 | Yano et al. | 501/32 |
| 4,820,660 | 4/1989 | Mohri et al. | 501/5 X |
| 4,857,486 | 8/1989 | Ebata et al. | 501/32 X |
| 4,898,597 | 2/1990 | Hay et al. | 51/309 X |
| 4,906,255 | 3/1990 | Nikitina et al. | 51/309 X |
| 4,919,991 | 4/1990 | Gadkaree | 501/8 X |
| 4,968,327 | 11/1990 | Efros | 51/309 X |
| 4,997,461 | 5/1991 | Markhoff-Matheny et al. | 51/309 X |

OTHER PUBLICATIONS

*Journal of the British Ceramic Society,* "The Strength of Experimental Grinding Wheel Materials including Use of Novel Glass and Glass-Ceramic Bonds" by T. I. Barry, L. A. Lay, R. Morrell. Issue 79, pp. 139-145, 1980.

*American Ceramic Society Bulletin,* "A Novel Technique for Producing a Glass-Ceramic Bond in alumina Abrasives" by Terence J. Clark and James S. Reed. Issue 65 (11) pp. 1506-1512 (1986).

*Primary Examiner*—Karl Group

*Attorney, Agent, or Firm*—David Bennett; Brian M. Kolkowski

[57] ABSTRACT

Abrasive tools are described which comprise abrasive grits held in a glass-ceramic bond in which at least 75% of the bond material is in bond posts or in coatings on individual grains.

7 Claims, 3 Drawing Sheets

GLASS-CERAMIC BONDED ABRASIVE ARTICLES

This is a continuation of application Ser. No. 07/704,165 filed Mar. 22, 1991, (now abandoned), which was itself a continuation-in-part of application Ser. No. 07/638,262 filed Jan. 7, 1991, (now abandoned).

BACKGROUND OF THE INVENTION

This invention relates to bonded abrasive articles and particularly those bonded with a bond material that can be converted to a semi-crystalline ceramic bond.

A vitreous bonded abrasive product, such as a conventional grinding wheel, comprises three volume components: an abrasive particulate material which usually occupies about 40 to 50 vol. %; a vitreous bond material that provides typically about 5 to 15 vol. % of the total; and the balance of the volume is void space. The function of the bond material is to hold the abrasive particles in place so that they can do the abrading work. In a typical vitreous bonded product of the prior art the glass components are added to the abrasive particles and the mixture is heated till the glass components melt, fuse to form a glass, and then flow to the particle contact points to form a bond post that solidifies on cooling. This provides the rigid structure of the finished product. In a more recent method the glass bond material is formed separately as a molten mass, cooled to solidify and then ground up. This ground up material, known as a frit, is then mixed with the abrasive particles. The advantage of this procedure is that the heating step can be shortened, the bond composition is more uniform and the forming temperature can often be reduced.

It will be appreciated that the rigidity and strength of the products of the prior art are often determined by the bond posts. Glass, being an amorphous material, has a low strength, (about 40 to about 70 MPa), by comparison with the abrasive particles. This low strength gives rise to premature release of grain and enhanced wear. Hence the grinding ability of vitreous bonded products is in theory limited by the strength of the posts. In practice, with most abrasives, such limitations were not very significant. Some more modern abrasives however are adapted to perform best under a heavy load and this puts the bond under considerable stress. Traditional glass bonds are often found inadequate under such conditions and there is therefore a need for vitreous-based bonds with a greater ability to operate under high stresses.

It has been proposed that there might be advantage in the use of a glass-ceramic bond to bond abrasives. However it has not been found possible heretofore to ensure that the bond material is concentrated in the bond posts or in coating the abrasive grits. This of course is extremely inefficient and has not resulted in any commercialization of such glass-ceramic bonded materials in spite of the potential advantages that might be expected.

The present invention provides such a bond material. It has significantly greater strength than traditional bonds and is easily formed. Abrasive products comprising such bond materials often perform substantially better than those made with prior art bonds. The bonds can be used with a wide variety of abrasives and exhibit an impressive versatility in the kinds of abrasive products that can be made with them.

DESCRIPTION OF THE INVENTION

The present invention provides a bonded abrasive product which comprises abrasive particles held together by a glass-ceramic bond material wherein at least 75% of the bond material is present in the form of bond posts or a coating on the abrasive particles and in which the volume proportion of bond to grain is from about 0.06 to about 0.6 and preferably from about 0.1 to about 0.4.

Glass-ceramic materials are defined for the purposes of this specification as materials that are processed and formed as glasses but which, on heating, can be converted to a semi-crystalline material with a crystallinity of at least about 50% and more preferably exceeding 80%, and a grain size, (longest dimension), of less than about 10 microns and preferably of about a micron or even less.

The glass ceramic can be tailored to the abrasive particle with which it is to be used so that it has a matched coefficient of thermal expansion, for example within 20% of that of the abrasive. This may often result in reduced thermal stresses within the structure and consequently enhanced strength. While such a match of expansion coefficients may often be desirable, it is not an essential feature of the broadest aspect of the present invention. The degree of crystallinity can be adjusted to give a match of the mechanical strength of the bond with the abrasive particles or to ensure that the particles release when they have been smoothed and cease to cut effectively.

The use of glass-ceramic bonds in a vitreous bonded abrasive wheel enables the wheel to be operated at higher rotational speeds because of the greater mechanical strength of the wheel. In addition it permits the use of less bond material to achieve a comparable level of performance as can be obtained with conventional vitreous bond materials. The greater bond strength also results in better corner holding and overall a significantly improved wheel by comparison with the prior art wheels made with conventional vitreous bonds.

The physical mechanism by which these results are obtained is not completely understood but it is thought to be related to the fracture mechanism in glasses. In an amorphous structure crack propagation is uninhibited by intervening structures and so the crack propagates until it reaches a surface and the glass breaks. In a glass-ceramic however the microcrystals dispersed in the glass matrix appear to cause crack branching which limits propagation and thus maintains the integrity of the structure far longer.

Glass-ceramic compositions tend to nucleate and crystallize at high viscosities and this tends to arrest deformation and densification. The selection of the components is therefore a matter of great importance. The key parameters are that the glass must flow, wet the abrasive particles, and form dense bond posts before, or at least concurrent with, the onset of crystallization. The flow properties are particularly important so as to ensure that the bond material in the final product is located in the bond posts or in a coating on the abrasive grits rather than in separated non-functional areas of the bonded material. In the present invention at least about 75% and preferably at least about 85%, or higher, is present in these locations, indicating that the desired degree of flow and coating has been achieved.

In the production of a glass-ceramic bonded abrasive article, the components are melted into a glass which is then cooled and ground to a powder, preferably one with a particle size of about 200 mesh or finer. In general, the finer the powder the better. This is because the surfaces of the particles present a plurality of potential surface nucleation sites and the greater the surface area of the glass powder, the larger the number of sites at which the desirable crystallinity can be initiated. The glass powder is then mixed with the abrasive in the requisite proportions along with any temporary binders, plasticizers and the like that may be desired. This mixture is then formed into a bonded abrasive product using conventional equipment. The critical parameter that determines the degree of crystallinity, (apart from the composition), is the firing schedule. This varies with the composition of the glass-ceramic and controls not only the degree of crystallinity but also the size of the crystals and ultimately the properties of the glass-ceramic. The firing schedule is often, but not essentially, a multi-step operation. In a typical schedule the dense glass bond posts are formed at an optimal temperature that is determined by the glass components. The product is then brought to the optimal nucleation temperature, (usually from about 30° C. below, to about 150° C. above the annealing temperature), for a fixed time, followed by a period at the optimal crystal growth temperature. As an alternative, with certain glass formulations, it is possible to carry out simultaneous nucleation and crystal growth at the bond post formation temperature.

This procedure gives rise to dense glass-ceramic bond posts that have significantly greater strengths than those of conventional glass bonds.

In some cases it is possible to provide that the crystalline material separating from the glass melt is itself an abrasive and contributes to the abrasive properties of the final product. In an extreme situation this separating abrasive material is the sole abrasive component of the mixture such that the abrasive is, so to speak, generated "in situ". In such an event however the desirable porosity of the abrasive composite must be supplied by other means such as sacrificial components, blowing agents or the like.

DESCRIPTION OF SPECIFIC EMBODIMENTS

The invention is now described with reference to certain preferred embodiments which are presented to provide illustrations of the invention only and are not intended to imply any necessary limitation on the essential scope of this invention.

BRIEF DESCRIPTION OF DRAWINGS

FIG. 1 presents two SEM micrographs at magnifications of 150, (1*a*), and 900, (1*b*), of a bonded structure according to the invention.

The production of a bonded product according to the invention is further illustrated with reference to the following Example.

EXAMPLE 1

A glass-ceramic bond material was made by preparing a lithium aluminosilicate, (LAS), glass powder having the composition shown in Table 1 below. The glass was obtained from Sandia National Laboratories under the designation "SB Glass". The composition information included below was derived from that source.

TABLE 1

| Raw Composition (wt %) | | Fused Composition (wt %) | |
|---|---|---|---|
| $SiO_2$ | 61.2 | $SiO_2$ | 74.4 |
| $Al_2O_3$ | 4.1 | $Al_2O_3$ | 5.0 |
| $H_3BO_3$ | 1.9 | $B_2O_3$ | 1.3 |
| $Li_2CO_3$ | 25.6 | $Li_2O$ | 12.5 |
| $K_2CO_3$ | 5.1 | $K_2O$ | 4.2 |
| $P_2O_5$ | 2.1 | $P_2O_5$ | 2.6 |

The glass batch was melted at about 1400°-1500° C. in a platinum crucible. The melting time was about 24 hours. The melting glass was intermittently stirred. Glass granules were prepared by water quenching the molten glass and then comminuting, (using a ball mill), to about 200 mesh or smaller by ball milling with alumina balls in an alumina mill for about 15 hours.

The glass powder was mixed with abrasive grains of an alpha-alumina, (SG Alumina), prepared by a seeded sol gel process, (microcrystalline size of about 0.2 micron), as described in U.S. Pat. No. 4,623,364 and a temporary binder int eh proportions shown in Table 2. The mixture was then subjected to the firing schedule which is also set forth in Table 2, as it was formed into a grinding wheel.

TABLE 2

| Mix formula (wt %) | |
|---|---|
| SG (80 grit) | 87.94 |
| Citric Acid (50% soln.) | 2.02 |
| Dextrin (first addition) | 0.88 |
| Dextrin (secon addition) | 0.94 |
| Glass frit | 8.21 |
| (The Dextrin was derived from corn starch.) | |
| Firing Schedule | |
| Ramp: | Room Temp. to 640° C. at 150° C./hour |
| Soak: | One hour |
| Ramp: | 640° C. to 930° C. at 25° C./minute |
| Soak: | One Hour |

At the same time a wheel was made from the same abrasive grain using a commercial vitreous bond used by Norton Co. in the production of vitreous bonded wheels. The bond is identified as HA4C. The same amount of bond and abrasive was used to produce a wheel of the same grade as the wheel of the invention whose production is described above.

Figure 1A:
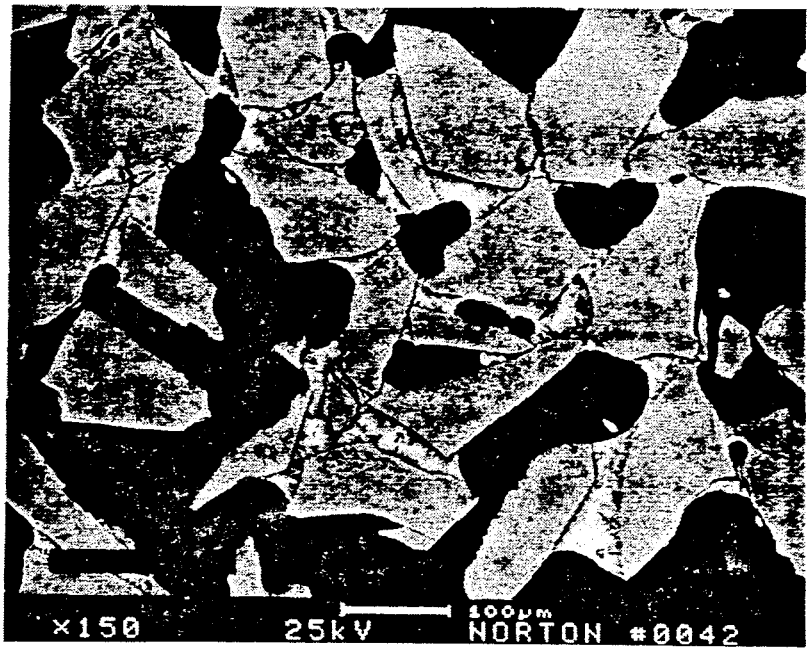
FIG. 1*a* shows the abrasive particles with the bond in place.
Figure 1B:
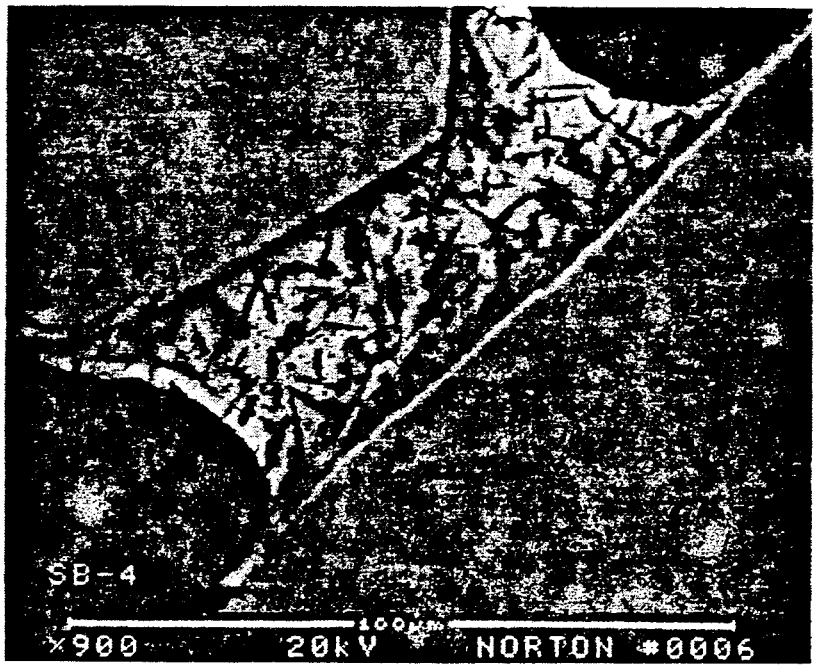
FIG. 1*b* show a single bond post and its microstructure. As can be seen the bond post comprises a plurality of fibrous crystals with random orientation. There is also a small amount of residual porosity.
Figure 2A:
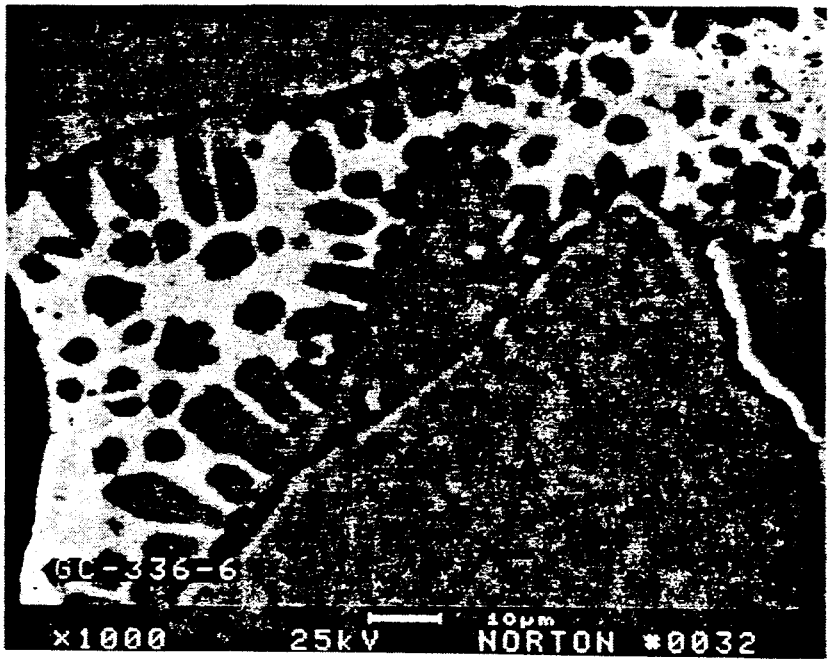
FIG. 2*a* shows spheroidal, and 2*b* shows dendritic crystal structures. Such structures can be obtained by suitable modifications to the firing schedules and the proportions of the components included in the mixture from which the glass-ceramic is formed.
Figure 2B:
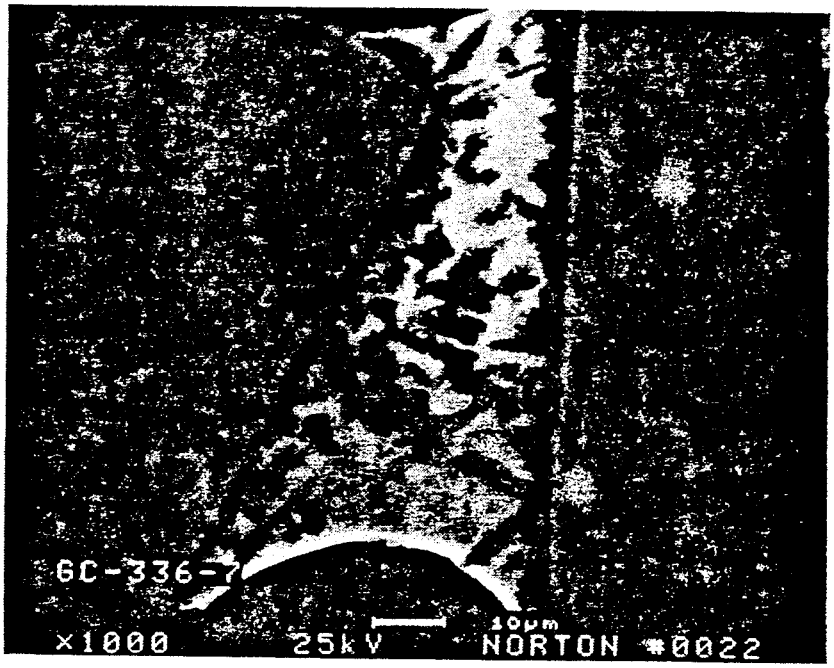
FIG. 2 comprises two SEM micrographs illustrating other kinds of crystal structure that can be present in a glass ceramic.
Figure 3A:
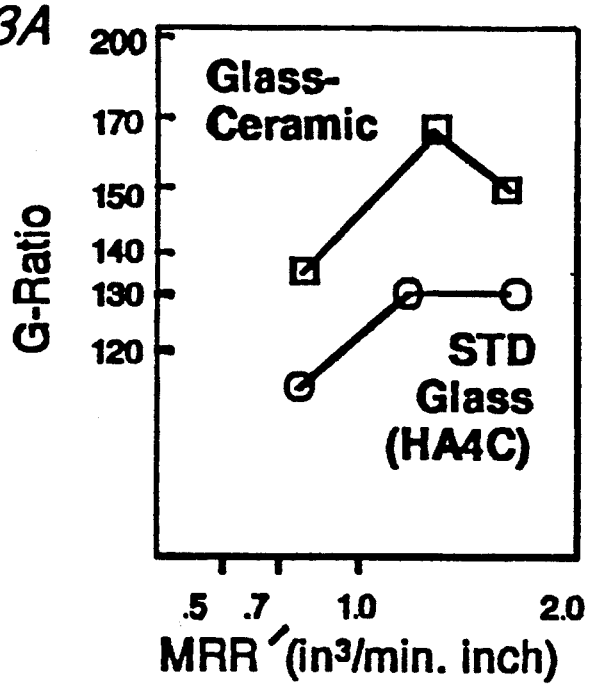
FIGS. 3(*a* and *b*) show graphs comparing the properties of bonded wheels that are identical except in terms of the bond. A conventional vitreous bond is compared with a glass-ceramic bond in accordance with the invention. The properties compared are G-Ratio and Cutting ability. The wheel according to the invention is the same as that described above in FIG. 1. The comparative wheel uses a commercial vitreous bond.
Figure 3B:
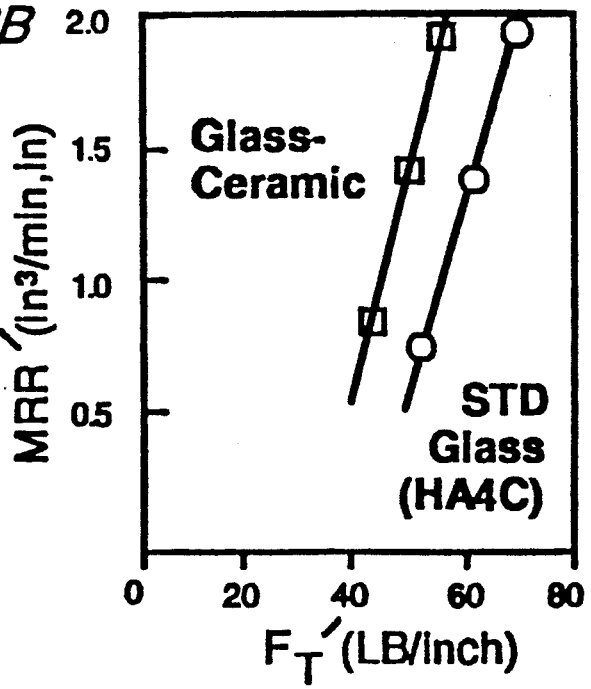

Typical SEM micrographs of the wheel of the invention are shown in FIG. 1. FIG. 1*a* shows that the bond has good flow and wetting of the grain particles and that good bond geometry has been achieved. The micrograph shows clearly that essentially all the bond material is located in bond posts or in a coating of the grain surface. FIG. 1*b* shows that the bond comprises predominantly of needle-like crystals dispersed in a glassy phase. The needles are determined, by X-Ray Diffraction techniques, to be lithium silicate with the formula $Li_2SiO_3$. In addition lithium phosphate and cristobalite crystals are present, as determined by X-ray diffraction, and the overall crystallinity in the bond was determined to be about 50%. This product as indicated below showed adequate performance but it is anticipated that a higher overall crystallinity will yield even better results.

The performance of the glass ceramic bonded wheel was compared with the wheel having the HA4C bond and the results are set forth in Table 3. The test consisted of the external wet grinding of hardened 52100 bearing steel, (Rc 58) using a 5% aqueous solution of Trim VHPE 300 fluid. The wheel speed was 12400 rpm and the workspeed was 100 rpm. The volume of metal removed per unit volume of wheel wear, (S/W or "the G-Ratio"), was measured. This determines in practice the total amount of metal that can be removed before the wheel has to be replaced. Another even more significant measure of a grinding wheel's utility is the "Quality Measure", ($S^2/W$), which takes into account not only the amount of metal that a wheel can remove, but also the rapidity with which this occurs.

TABLE 3

Wheel Properties/Performance: Wet grinding 52100 Steel

| Bond Used | Comp. Dens. $g/cm^3$ | MRR $in^3/min.in$ | Power HP/in. | G-Rat. S/W | Quality $S^2/W$ |
|---|---|---|---|---|---|
| Glass-cer. | 2.262 | 0.809 | 14.1 | 134.5 | 108.7 |
| | | 1.348 | 16.0 | 162.9 | 219.7 |
| | | 2.020 | 18.6 | 147.7 | 298.3 |
| HA4C | 2.260 | 0.757 | 16.3 | 118.4 | 89.7 |
| | | 1.287 | 18.9 | 130.0 | 167.3 |
| | | 1.906 | 21.1 | 129.8 | 247.4 |

From Table 3 it is apparent that both the G-Ratio and the Quality Measure were markedly improved by the use of the glass-ceramic bond. It may also be observed that the wheel with the glass-ceramic bond cuts faster for a given power output.

As will be appreciated the glass-ceramic bonded products of the invention are extremely versatile and can be tailored to almost any specification. The key variable is the firing schedule which varies with the formulation and the desired density of the crystal structure in the matrix. At all events it is necessary to ensure that the crystallization does not interfere with the flow and wetting of the grains or the formation of dense bond posts. Within these limitations, the crystallization can occur at any convenient time and extent.

The abrasive grain which is bonded by the glass-ceramic is not limited to the seeded sol gel alpha aluminas described above. Indeed any abrasive particles, or mixtures of particles, may be used. These could include for example, fused alumina, silicon carbide, cubic boron nitride, fused alumina/zirconia, diamond or any of the modifications or variations of any of the above, as well as others that are less commonly encountered. With some combinations it may be necessary to add other components to enhance interactions between the grain and the bond. As a rule the presence of these in no way detracts from the usefulness of the products of the invention.

The abrasive products can be made into any useful shape such as a wheel, a hone, a pad, a wheel segment, and the like. It is however noted that the invention has its greatest utility in the application in which the strength of the bond is most tested and this tends to be in the context of grinding wheels.

What is claimed is:

1. An abrasive tool that comprises abrasive grains bonded together by a glass-ceramic bond material having a crystalline content of at least 50% by volume, said tool comprising from about 35% to about 55% void spaces, wherein about 75% of the volume of the bond material is located in bond posts or in a coating on the abrasive grains and in which the volume proportion of bond to grain is from about 0.06 to about 0.6.

2. An abrasive tool according to claim 1 in which at least about 85% of the bond material is located in bond posts or in a coating on the abrasive grains.

3. An abrasive tool according to claim 1 in which the glass-ceramic comprises at least 80% by volume of crystalline material.

4. An abrasive tool according to claim 1 in which the volume proportion of bond to grain is from about 0.1 to about 0.4.

5. An abrasive tool according to claim 1 in which the abrasive grains are an alpha alumina with an average microcrystalline size of less than one micron.

6. An abrasive tool according to claim 1 in which the bond material is formed from a lithium aluminosilicate frit.

7. An abrasive tool according to claim 1 in which the glass-ceramic and the abrasive grains have coefficients of thermal expansion that are within about 20% of each other.

* * * * *